US008305322B2

(12) United States Patent
Chung et al.

(10) Patent No.: US 8,305,322 B2
(45) Date of Patent: Nov. 6, 2012

(54) DISPLAY SUBSTRATE OF FLAT PANEL DISPLAY

(75) Inventors: Chun-Fan Chung, Hsin-Chu (TW); Sheng-Kai Hsu, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 749 days.

(21) Appl. No.: 12/371,957

(22) Filed: Feb. 17, 2009

(65) Prior Publication Data

US 2010/0053057 A1 Mar. 4, 2010

(30) Foreign Application Priority Data

Aug. 26, 2008 (TW) ..... 97132609 A

(51) Int. Cl.
*G09G 3/36* (2006.01)

(52) U.S. Cl. ..... 345/98; 345/87; 345/204; 345/205; 345/38

(58) Field of Classification Search ..... 345/87, 345/98
See application file for complete search history.

(56) References Cited

U.S. PATENT DOCUMENTS

| | | | | |
|---|---|---|---|---|
| 5,870,163 | A * | 2/1999 | Watanabe et al. | 349/149 |
| 6,297,868 | B1 * | 10/2001 | Takenaka et al. | 349/151 |
| 7,894,033 | B2 * | 2/2011 | Matsuura | 349/149 |
| 2001/0015709 | A1 * | 8/2001 | Imajo et al. | 345/87 |
| 2001/0048415 | A1 | 12/2001 | Morii | |
| 2004/0252113 | A1 * | 12/2004 | Vicentini et al. | 345/205 |
| 2006/0233003 | A1 | 10/2006 | Iwanaga et al. | |
| 2007/0081117 | A1 * | 4/2007 | Liu et al. | 349/150 |
| 2008/0084371 | A1 * | 4/2008 | Yang et al. | 345/87 |

FOREIGN PATENT DOCUMENTS

CN 1959970 A 5/2007

* cited by examiner

*Primary Examiner* — Muhammad N Edun
(74) *Attorney, Agent, or Firm* — Chun-Ming Shih

(57) ABSTRACT

A driver integrated circuit chip adapted to electrically couple with a fan-out wiring area includes a side and a plurality of output pins formed at the side. The output pins includes a first pin group and a second pin group. The first pin group is electrically coupled to the fan-out wiring area. The second pin group is located at at least one side of the first pin group and opened. The present invention also provides display substrates of flat panel display each adapted to electrically couple with a plurality of driver integrated circuit chips.

9 Claims, 9 Drawing Sheets

DISPLAY SUBSTRATE OF FLAT PANEL DISPLAY

CROSS-REFERENCE TO RELATED APPLICATIONS

This application is based upon and claims the benefit of priority from the prior Taiwanese Patent Application No. 097132609, filed Aug. 26, 2008, the entire contents of which are incorporated herein by reference.

BACKGROUND

1. Technical Field

The present invention generally relates to flat panel display field and, particularly, to a driver integrated circuit (IC) chip and display substrates of flat panel display adapted to electrically couple with a plurality of driver IC chips.

2. Description of the Related Art

Flat panel displays such as a liquid crystal display (LCD) and a plasma display have the advantages of high image quality, small size, light weight and a broad application range, and thus are widely applied on consumer electronic products such as a mobile phone, a notebook computer, a desktop display and a television, and have gradually replaced the traditional cathode ray tube (CRT) displays as the main trend in the display industry.

Referring to FIG. 7, a conventional flat panel display 30 includes a display substrate 31, a printed circuit board 33 and flexible printed circuit boards P1, P2. The flexible printed circuit boards P1, P2 are electrically coupled between the display substrate 31 and the printed circuit board 33.

The display substrate 31 includes a display area 310 (as denoted by the dashed rectangle in FIG. 7), a peripheral area 311 located at sides of the display area 310, a plurality of source driver IC chips SD1~SD8, a plurality of gate driver IC chips GD1~GD3 and a plurality of fan-out wiring areas 314. The display area 310 has a plurality of gate control lines GL (of which only one is shown in FIG. 7 for illustration purposes), a plurality of data lines DL (of which only one is shown in FIG. 7 for illustration purposes) and a plurality of display elements P (of which only one is shown in FIG. 7 for illustration purposes) formed therein. The display elements P are electrically coupled to the respective gate control lines GL and the respective data lines DL. The peripheral area 311 has the source driver IC chips SD1~SD8, the gate driver IC chips GD1~GD3 and the fan-out wiring areas 314 formed therein. The source driver IC chips SD1~SD8 contain four groups of cascade connected source driver IC chips respectively coupled to different conductive wires 315 formed on the display substrate 31 by WOA technology. The gate driver IC chips GD1~GD3 are cascade connected to one conductive wire 315. The fan-out wiring areas 314 are electrically coupled between the respective source driver IC chips SD1~SD8 and gate driver IC chips GD1~GD3 and the display area 310.

The printed circuit board 33 generally has a gamma voltage generator and a DC-to-DC converter formed thereon to output a gamma voltage and power signals. The gamma voltage and the power signals then are delivered to the source driver IC chips SD1~SD8 and the gate driver IC chips GD1~GD3 through the flexible printed circuit boards P1, P2 and the conductive wires 315. The gamma voltage and the DC-to-DC converter are not drawn in FIG. 7.

The source driver IC chips SD1~SD8 and the gate driver IC chips GD1~GD3 are chip-on-glass (COG) chips. FIG. 8 is a schematic enlarged view of any one of the source driver IC chips SD1~SD8 and the gate driver IC chips GD1~GD3 being COG chips. Referring to FIGS. 7 and 8, an output side of the COG chip in FIG. 8 has a plurality of output pins 3121, 3131 formed thereat. The output pins 3121 in the dashed frame of FIG. 8 constitute an opened pin group 312 unconnected with any one of the fan-out wiring areas 314. The output pins 3131 constitute a second pin group 313 connected with one of the fan-out wiring areas 314. The opened pin group 312 is located at the middle of the second pin group 313.

FIG. 9 is a schematic enlarged view of any one of the source driver IC chips SD1~SD8 and the gate driver IC chips GD1~GD3 being chip-on-film (COF) chips. The COF chip in FIG. 9 includes a flexible film and an IC die mounted on the flexible film. The output pins 3121, 3131 are formed on flexible film. The second pin group 313 on the COF chip is located at two ends of the output side and the opened pin group 312 also is located at the middle of the second pin group 313. It is indicated that, when the source driver IC chips SD1~SD8 and the gate driver IC chips GD1~GD3 are COF chips, they are not directly mounted on the display substrate 31 as shown in FIG. 7 but electrically coupled to the display substrate 31 through the respective flexible films of themselves.

However, since the second pin group 313 of each of the driver IC chips SD1~SD8 and GD1~GD3 is located at two opposite ends of the output side, which results in transmission paths of the power signals and/or the gamma voltage delivered to the sided output pins 3131 of the second pin groups 313 of the tailmost driver IC chips SD1, SD4, SD5, SD8 and GD3 of the groups of cascade connected driver IC chips are excessive long and thus the power drops are serious. Accordingly, the outputs of the driver IC chips SD1, SD4, SD5, SD8 and GD3 are dramatically influenced by the power drops.

BRIEF SUMMARY

The present invention relates to a driver IC chip can effectively avoid an output thereof to suffer from dramatic influence of serious power drop.

The present invention further relates to a display substrate of flat panel display, an output of a driver IC chip thereof can be effectively avoided to suffer from dramatic influence of serious power drop.

In order to achieve the above-mentioned advantages, a driver IC chip in accordance with an embodiment of the present invention is provided. The driver IC chip is adapted to electrically couple with a fan-out wiring area. The driver IC chip includes a side and a plurality of output pins formed at the side. The output pins includes a first pin group and a second pin group. The first pin group is electrically coupled to the fan-out wiring area. The second pin group is located at at least one side of the first pin group and opened.

In one embodiment, the second pin group is located at one side of the first pin group.

In one embodiment, the second pin group is located at two opposite sides of the first pin group.

A display substrate of flat panel display in accordance with another embodiment of the present invention is provided. The display substrate of flat panel display is adapted to electrically couple with a plurality of driver IC chips. The display substrate of flat panel display includes a display area and a plurality of fan-out wiring areas. The display area has a plurality of display elements formed therein. The fan-out wiring areas are electrically coupled between the respective driver IC chips and the display area so as to transmit signals provided by the respective driver IC chips to the display area. At least one driver IC chip of the driver IC chips each includes a side and a plurality of output pins formed at the side. The output pins include a first pin group and a second pin group, the first pin group is electrically coupled to one of the fan-out wiring areas, the second pin group is located at at least one side of the first pin group and opened.

In one embodiment, the driver IC chips include at least one group of cascade connected driver IC chips, the second pin group of the tailmost driver IC chip of each of the at least one group of cascade connected driver IC chips is located at one side of the first pin group thereof and opened.

In one embodiment, the driver IC chips include at least one group of cascade connected driver IC chips, the second pin group of each driver IC chip of each of the at least one group of cascade connected driver IC chips is located at two opposite sides of the first pin group thereof and opened.

In one embodiment, the driver IC chips are source driver IC chips.

In one embodiment, the driver IC chips are gate driver IC chips.

Another display substrate of flat panel display in accordance with further another embodiment of the present invention is provided. The display substrate of flat panel display is adapted to electrically couple with a plurality of first-type driver IC chips and a plurality of second-type driver IC chips. The display substrate of flat panel display includes a display area, a plurality of first fan-out wiring areas and a plurality of second fan-out wiring areas. The display area has a plurality of display elements formed therein. The first fan-out wiring areas are electrically coupled between the respective first-type driver IC chips and the display area so as to transmit first-type signals provided by the respective first-type driver IC chips to the display area. The first-type signals are for providing same functions applied to the display elements. The second fan-out wiring areas are electrically coupled between the respective second-type driver IC chips and the display area so as to transmit second-type signals provided by the respective second-type driver IC chips to the display area. The second-type signals are for providing same functions applied to the display elements. At least one first-type driver IC chip of the first-type driver IC chips each includes a side and a plurality of output pins formed at the side. The output pins include a first pin group and a second pin group, the first pin group is electrically coupled to one of the first fan-out wiring areas, the second pin group is located at at least one side of the first pin group and opened.

In one embodiment, the first-type driver IC chips include at least one group of cascade connected first-type driver IC chips, the second pin group of the tailmost first-type driver IC chip of each of the at least one group of cascade connected first-type driver IC chips is located at one side of the first pin group thereof and opened.

In one embodiment, the first-type driver IC chips include at least one group of cascade connected first-type driver IC chips, the second pin group of each first-type driver IC chip of each of the at least one group of cascade connected first-type driver IC chips is located at two opposite sides of the first pin group thereof and opened.

In one embodiment, the first-type driver IC chips are source driver IC chips.

In one embodiment, the first-type driver IC chips are gate driver IC chips.

In the above-mentioned embodiments of the present invention, the opened second pin group which is formed at a side of the driver IC chip is located at at least one side of the first pin group, the excessive long transmission paths for signals in the prior art are removed off and thus the serious power drops can be relieved. Accordingly, the output of the driver IC chip can be effectively avoided to suffer from the dramatic influence of the serious power drops.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "left," "right," "front," "back," etc., is used with reference to the orientation of the Figure(s) being described. The components of the present invention can be positioned in a number of different orientations. As such, the directional terminology is used for purposes of illustration and is in no way limiting.

Figure 1:
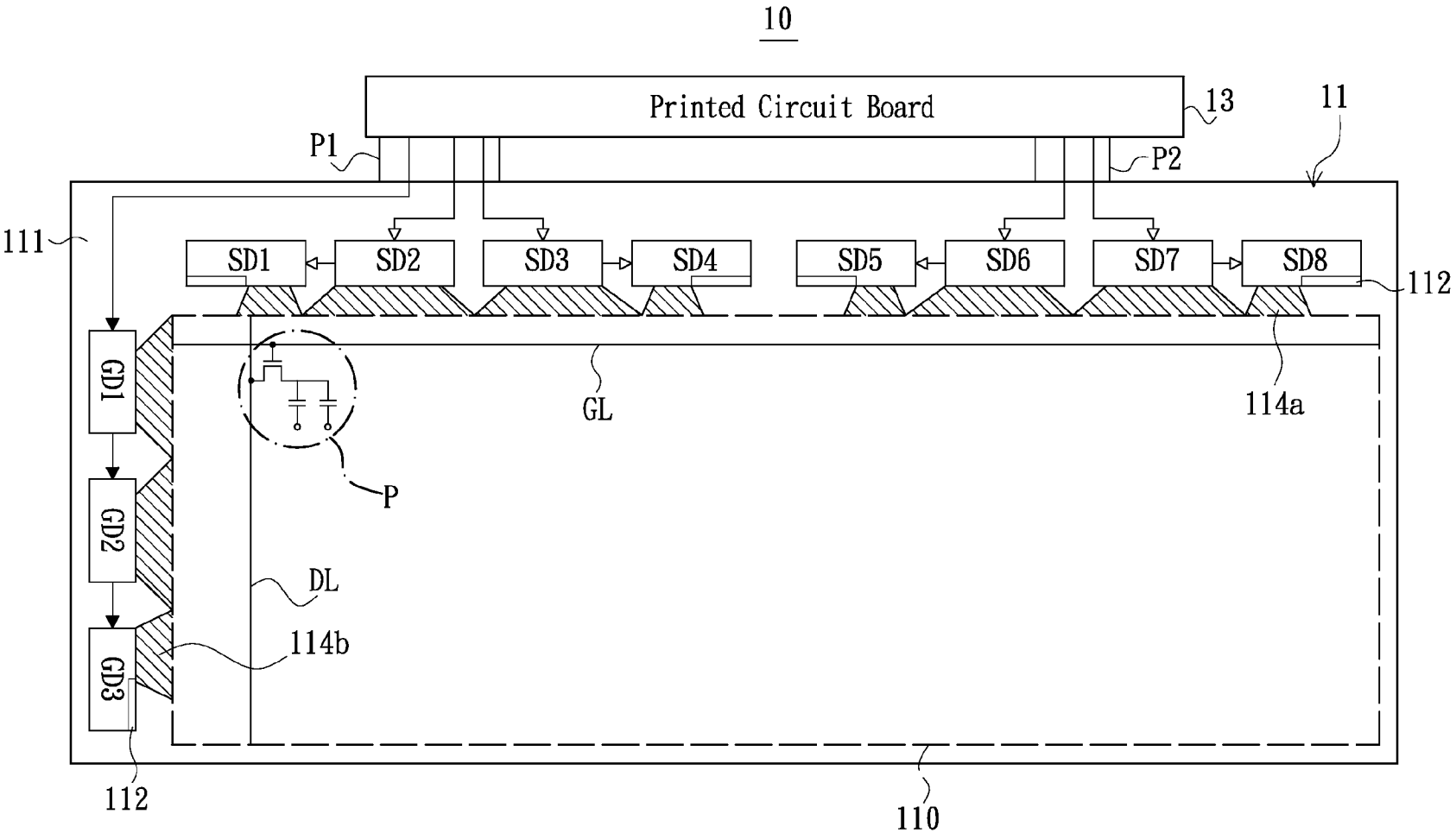
FIG. 1 is structural view of a flat panel display in accordance with a first embodiment of the present invention.

Referring to FIG. 1, a flat panel display 10 in accordance with a first embodiment of the present invention includes a display substrate 11, a printed circuit board 13 and flexible printed circuit boards P1, P2. The flexible printed circuit boards P1, P2 are coupled between the display substrate 11 and the printed circuit board 13.

The display substrate 11 includes a display area 110 (as denoted by the dashed rectangle in FIG. 1), a peripheral area 111 located at sides of the display area 110, a plurality of source driver IC chips SD1~SD8, a plurality of gate driver IC chips GD1~GD3, a plurality of first fan-out wiring areas 114*a* and a plurality of second fan-out wiring areas 114*b*.

The display area 110 has a plurality of gate control lines GL (of which only one is shown in FIG. 1 for illustration purposes), a plurality of data lines DL (of which only one is shown in FIG. 1 for illustration purposes) and a plurality of display elements P (of which only one is shown in FIG. 1 for illustration purposes) formed therein. The display elements P are electrically coupled to the respective gate control lines GL and the respective data lines DL.

The peripheral area 111 has the source driver IC chips SD1~SD8, the gate driver IC chips GD1~GD3, the first fan-out wiring areas 114*a* and the second fan-out wiring areas 114*b* formed therein. The source driver IC chips SD1 and SD2, SD3 and SD4, SD5 and SD6, SD 7 and SD8 respectively are electrically connected in series and thus constitute four groups of cascade connected source driver IC chips. The gate driver IC chips GD1~GD3 are connected to one another in series and thus constitute one group of cascade connected gate driver IC chips. The first fan-out wiring areas 114*a* are electrically coupled between the respective source driver IC chips SD1~SD8 and the display area 110 so as to transmit data signals provided by the respective source driver IC chips SD1~SD8 to the display area 110. The second fan-out wiring areas 114*b* are electrically coupled between the respective gate driver IC chips GD1~GD3 and the display area 110 so as to transmit gate control signals provided by the respective gate driver IC chips GD1~GD3 to the display area 110.

The printed circuit board 13 has a gamma voltage generator and a DC-to-DC converter formed thereon to output a gamma voltage and power signals. The gamma voltage and the power signals are delivered to the source driver IC chips SD1~SD8 and the gate driver IC chips GD1~GD3 through the flexible printed circuit boards P1, P2 and the conductive wires formed on the display substrate 11 by WOA technology. The gamma voltage generator and the DC-to-DC converter are not drawn in FIG. 1.

Figure 2:
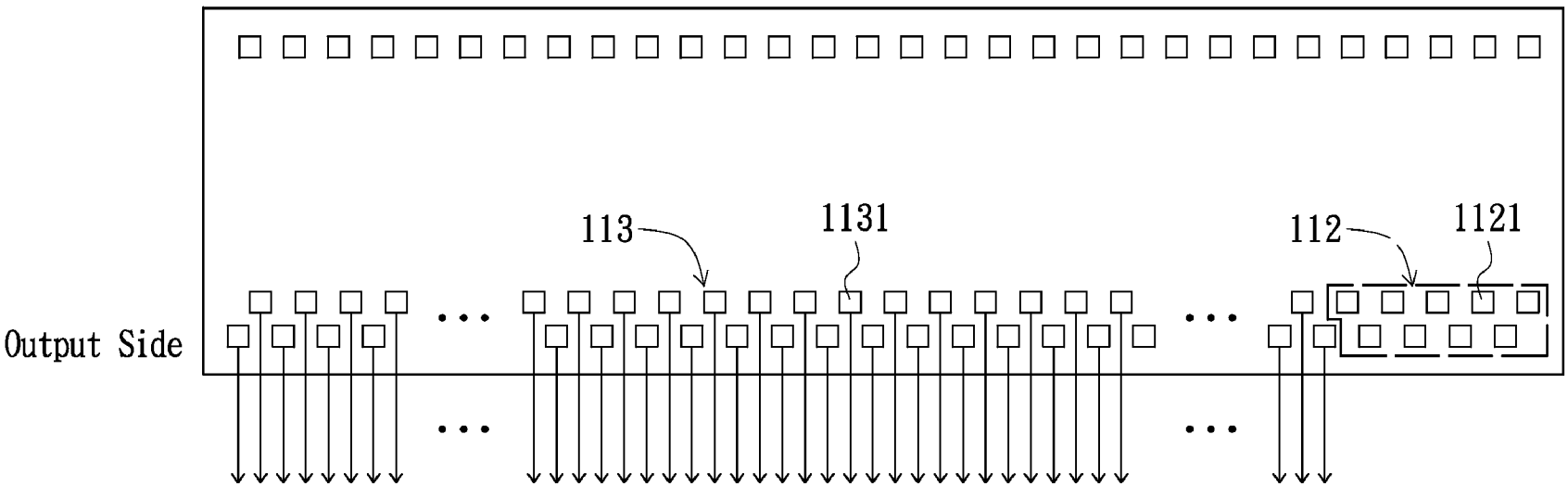
FIG. 2 is a schematic enlarged view of a COG chip in accordance with the first embodiment of the present invention.

The source driver IC chips SD1~SD8 and the gate driver IC chips GD1~GD3 all are COG chips. FIG. 2 is a schematic enlarged view of any one of the tailmost source driver IC chips SD1, SD4, SD5 and SD8 of the four groups of cascade connected source driver IC chips and the tailmost gate driver IC chip GD3 of the group of cascade connected gate driver IC chips.

Referring to FIGS. 1 and 2, an output side of the COG chip in FIG. 2 has a plurality of output pins 1121, 1131 formed thereat. The output pins 1121 in the dash frame of FIG. 2 constitute an opened pin group 112 which is unconnected with any one of the first and second fan-out wiring areas 114*a*, 114*b*. The output pins 1131 constitute a second pin group 113 electrically coupled to one of the first and second fan-out wiring areas 114*a*, 114*b*. The opened pin group 112 is located at one side of the second pin group 113.

Figure 3:
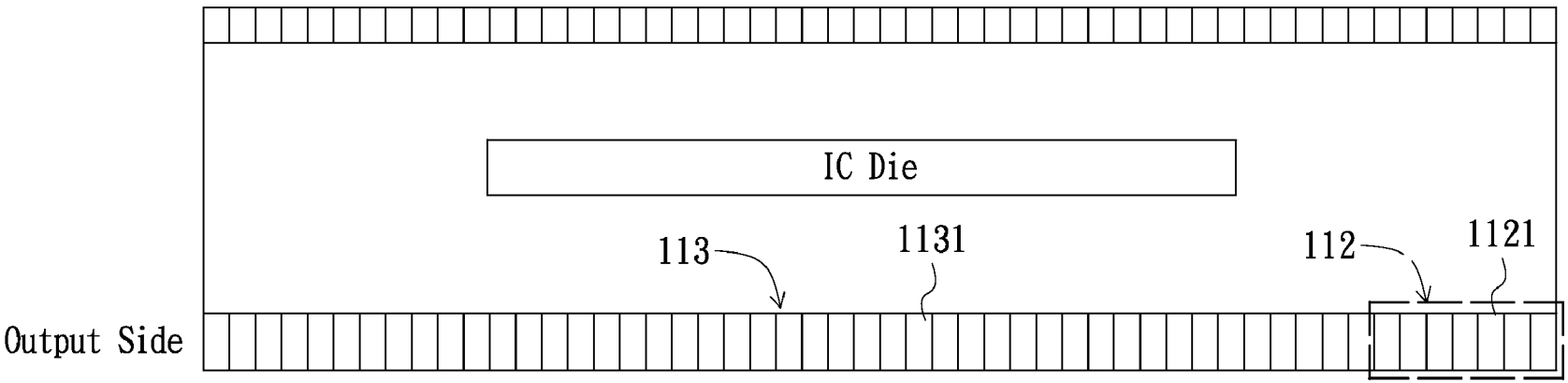
FIG. 3 is a schematic enlarged view of a COF chip in accordance with the first embodiment of the present invention.

It is understood that, the source driver IC chips SD1~SD8 and the gate driver IC chips GD1~GD3 all can be COF chips instead. In this situation, the source driver IC chips SD1~SD8 and the gate driver IC chips GD1~GD3 are not directly mounted on the display substrate 11 but electrically coupled to the display substrate 11 through the respective flexible films of themselves. FIG. 3 is a schematic enlarged view of any one of the tailmost source driver IC chips SD1, SD4, SD5, SD8 and gate driver IC chip GD3 being COF chips. The COF chip in FIG. 3 includes a flexible film and an IC die formed on the flexible film, the output pins 1121, 1131 are formed on the flexible film. A relative positional relationship between the opened pin group 112 and the second pin group 113 of the COF chip in FIG. 3 are the same as the illustration of FIG. 2 where the opened pin group 112 is located at one side of the second pin group 113.

Figure 4:
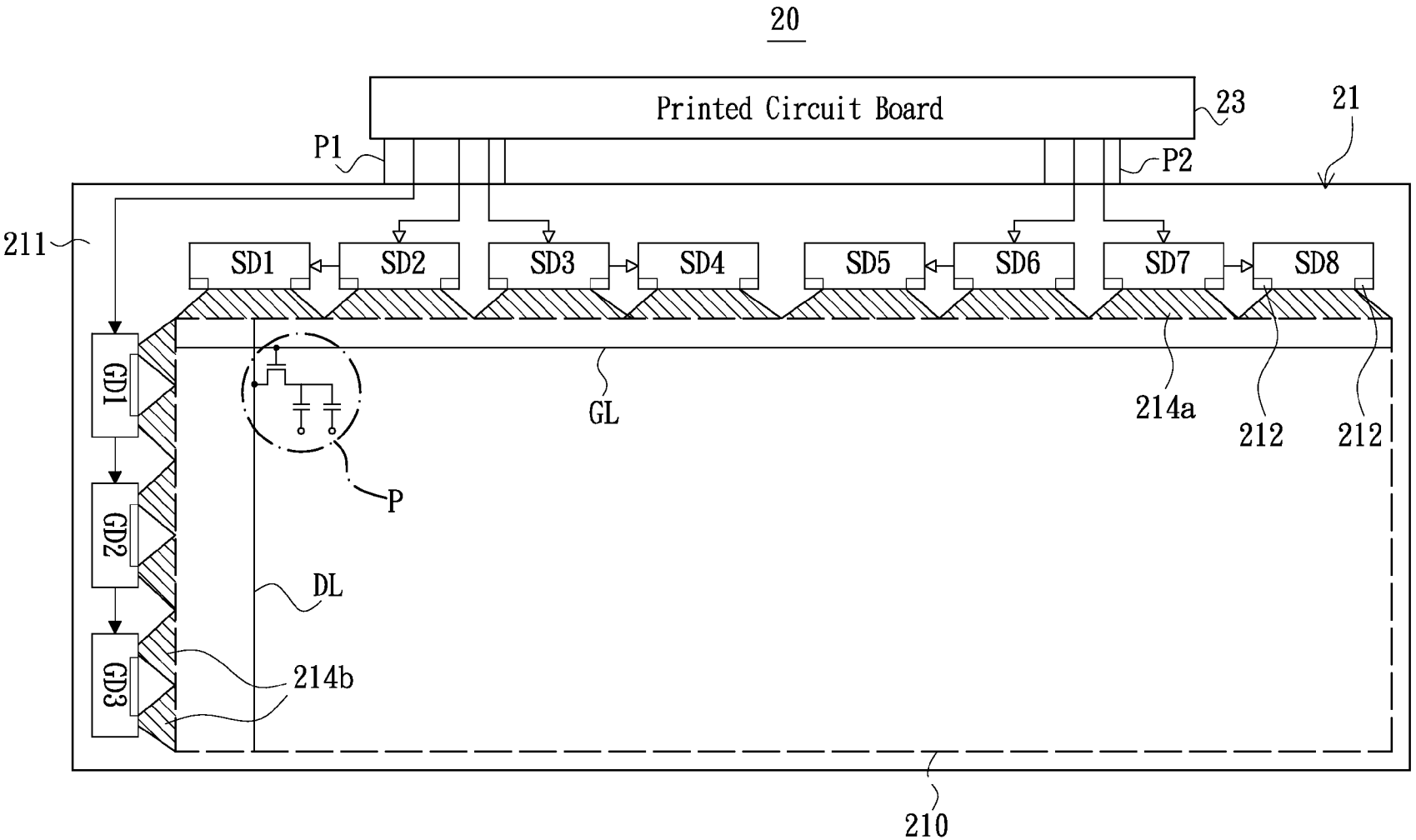
FIG. 4 is structural view of a flat panel display in accordance with a second embodiment of the present invention.

Referring to FIG. 4, a flat panel display 20 in accordance with a second embodiment of the present invention is provided. The flat panel display 20 includes a display substrate 21, a printed circuit board 23 and flexible printed circuit boards P1, P2. The flexible printed circuit boards P1, P2 are electrically coupled between the display substrate 21 and the printed circuit board 23.

The display substrate 21 includes a display area 210 (as denoted by the dashed rectangle of FIG. 4), a peripheral area 211 located at sides of the display area 210, a plurality of source driver IC chips SD1~SD8, a plurality of gate driver IC chips GD1~GD3, a plurality of first fan-out wiring area 214*a* and a plurality of second fan-out wiring area 214*b*.

The display area 210 has a plurality of gate control lines GL (of which only one is shown in FIG. 4 for illustration purposes), a plurality of data lines DL (of which only one is shown in FIG. 4 for illustration purposes) and a plurality of display elements P (of which only one is shown in FIG. 4 for illustration purposes) formed therein. The display elements P are electrically coupled to the respective gate control lines GL and the respective data lines DL.

The peripheral area 211 has the source driver IC chips SD1~SD8, the gate driver IC chips GD1~GD3, the first fan-out wiring areas 214*a* and the second fan-out wiring areas 214*b* formed therein. The source driver IC chips SD1 and SD2, SD3 and SD4, SD5 and SD6, SD7 and SD8 respectively are connected in series and thus constitute four groups of cascade connected source driver IC chips. The gate driver IC chips GD1~GD3 are electrically coupled to one another in series and thus constitute one group of cascade connected gate driver IC chips. The first fan-out wiring areas 214*a* are electrically coupled between the respective source driver IC chips SD1~SD8 and the display area 210 so as to transmit data signals provided by the source driver IC chips SD1~SD8 to the display area 210. The second fan-out wiring areas 214*b* are electrically coupled between the respective gate driver IC chips GD1~GD3 and the display area 210 so as to transmit gate control signals provided by the gate driver IC chips GD1~GD3 to the display area 210.

The printed circuit board 23 generally has a gamma voltage generator and a DC-to-DC converter formed thereon to output a gamma voltage and power signals. The gamma voltage and the power signals are delivered to the source driver IC chips SD1~SD8 and the gate driver IC chips GD1~GD3 through the flexible printed circuit boards P1, P2 and conductive wires formed on the display substrate 21 by WOA technology. The gamma voltage generator and the DC-to-DC converter are not drawn in FIG. 4.

Figure 5:
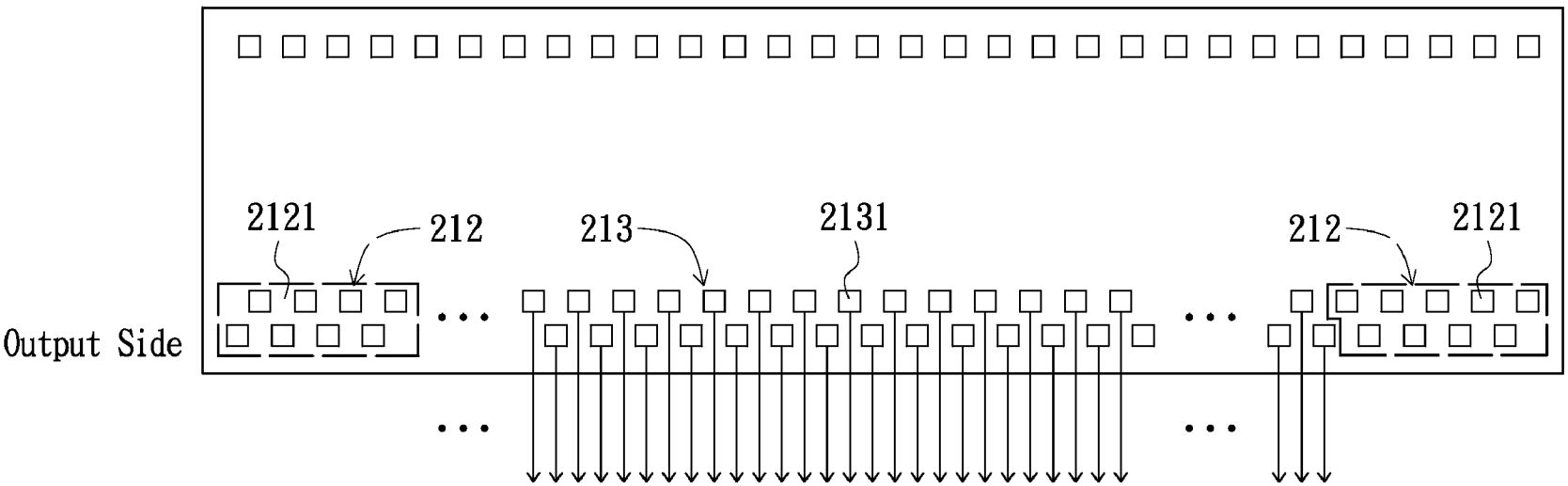
FIG. 5 is a schematic enlarged view of a COG chip in accordance with the second embodiment of the present invention.

The source driver IC chips SD1~SD8 are COG chips. FIG. 5 is a schematic enlarged view of any one source driver IC chip of the four groups of cascade connected source driver IC chips SD1~SD8.

Figure 7:
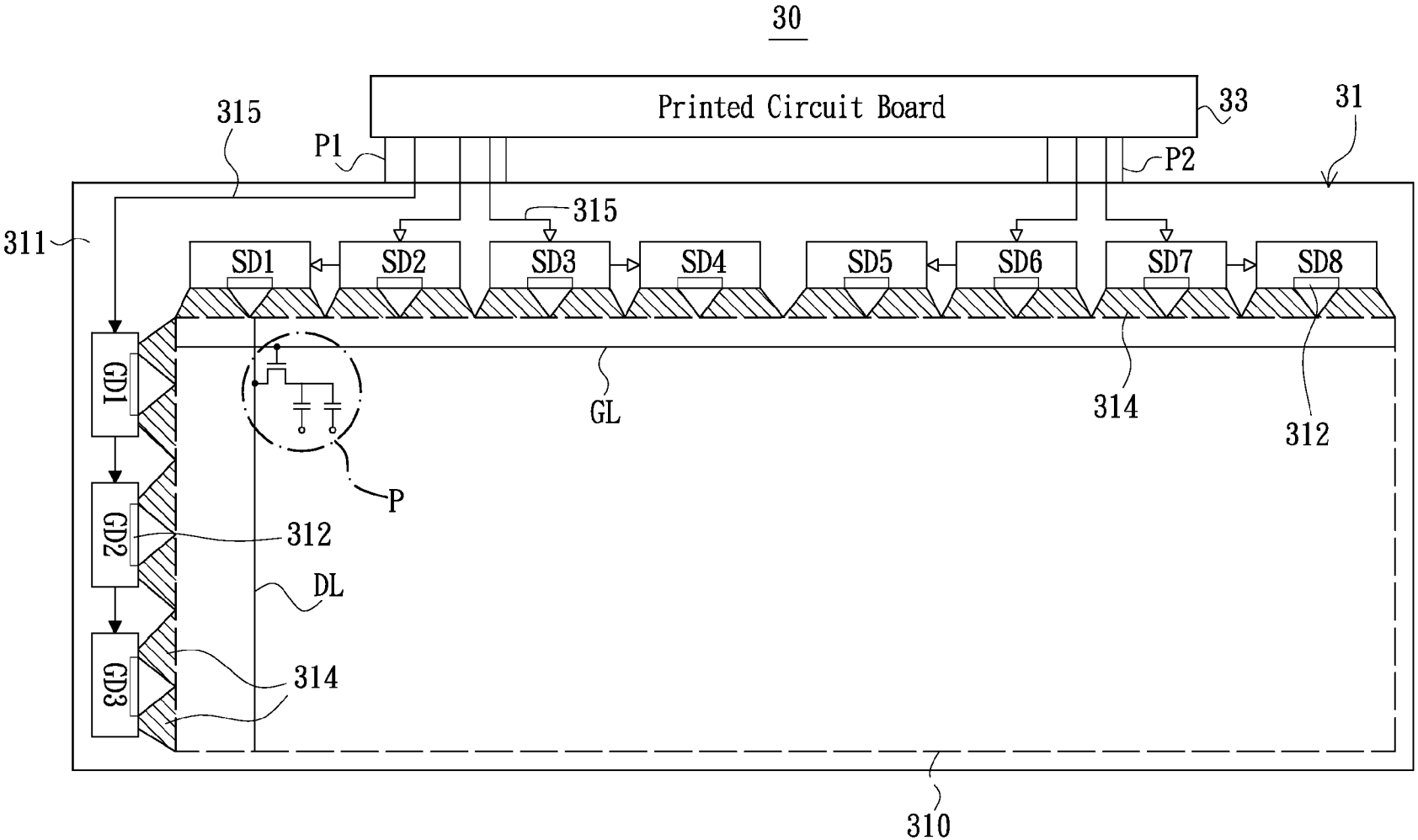
FIG. 7 (Prior Art)
FIG. 7 is a schematic view of a conventional flat panel display.
Figure 8:
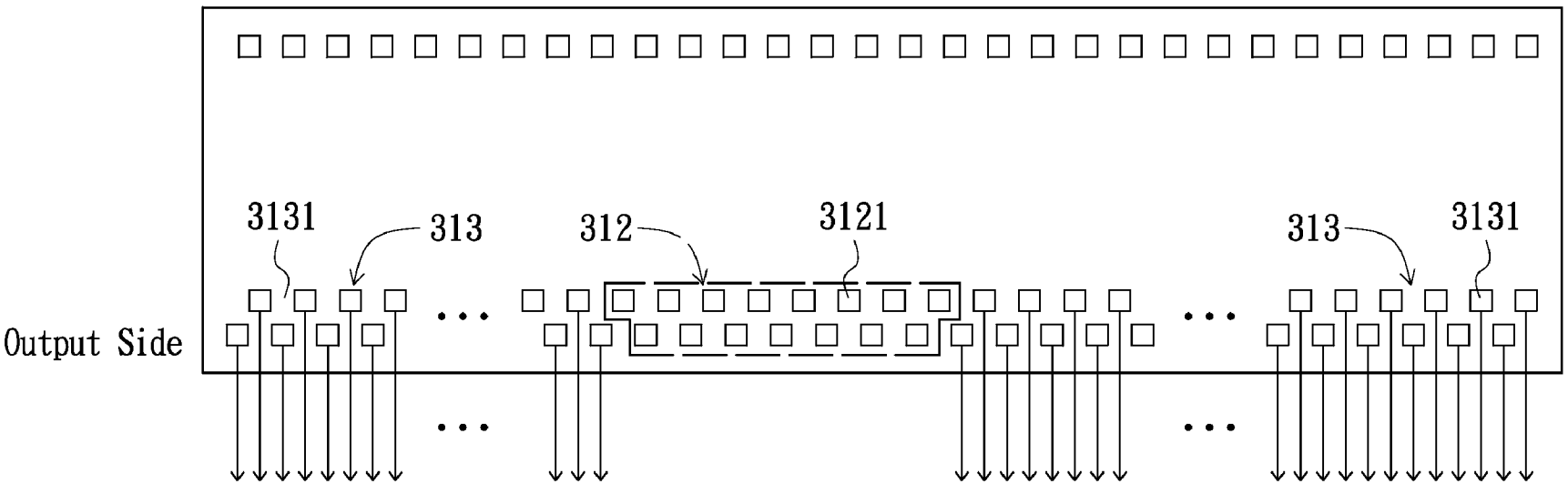
FIG. 8 (Prior Art)
FIG. 8 is a schematic enlarged view of a conventional COG chip.
Figure 9:
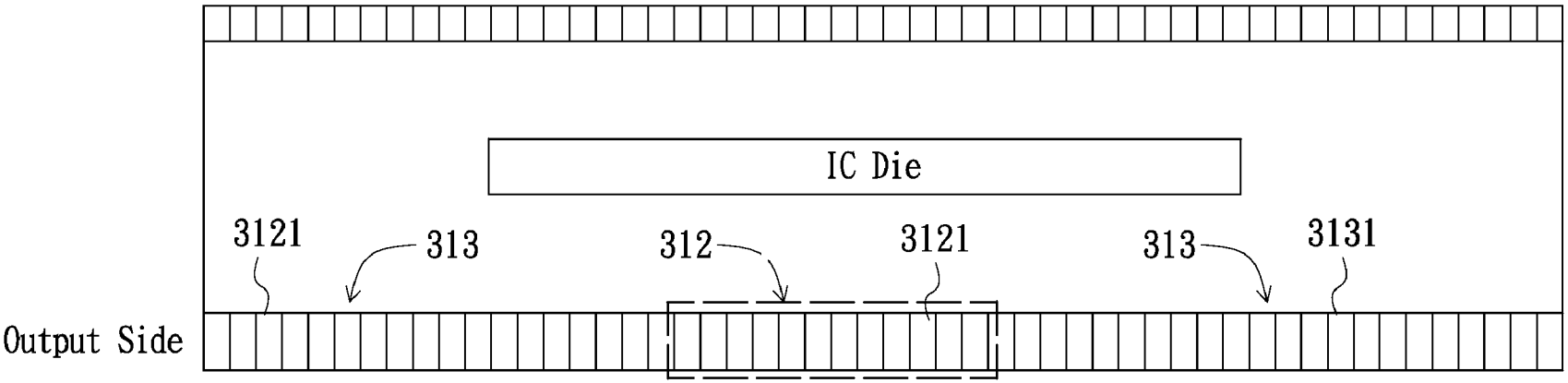
FIG. 9 (Prior Art)
FIG. 9 is a schematic enlarged view of a conventional COF chip.

Referring to FIGS. 4 and 5, an output side of the COG chip in FIG. 5 has a plurality of output pins 2121, 2131 formed thereat. The output pins 2121 in the dashed frames of FIG. 5 constitute an opened pin group 212 which is unconnected with any one of the first and second fan-out wiring areas 214*a*, 214*b*. The output pins 2131 constitute a second pin group 213 connected with one of the first fan-out wiring areas 214*a*. The opened pin group 212 is located at two opposite sides of the second pin group 213. A positional configuration of the opened pin group of each of the gate driver IC chips GD1~GD3 in FIG. 4 is the same as the positional configuration of the opened pin group of each gate driver IC chip GD1~GD3 as illustrated in FIG. 7 and thus will not be described in detail herein.

Figure 6:
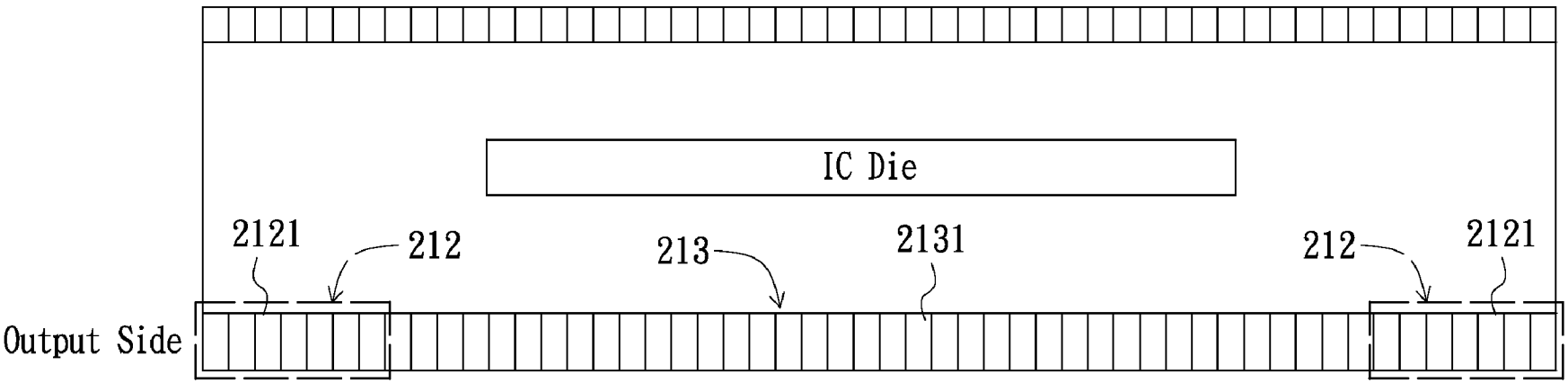
FIG. 6 is a schematic enlarged view of a COF chip in accordance with the second embodiment of the present invention.

It is understood that, the source driver IC chips SD1~SD8 can be COF chips instead. In this circumstance, the source driver IC chips SD1~SD8 are not directly mounted on the display substrate 21 but electrically coupled with the display substrate 21 through the respective flexible films of themselves. FIG. 6 is a schematic enlarged view of any one source driver IC chip of the four groups of cascade connected source driver IC chips SD1~SD8 being COF chips. The COF chip in FIG. 6 includes a flexible film and an IC die formed on the flexible film, the output pins 2121, 2131 are formed on the flexible film. A relative positional relationship between the opened pin group 212 and the second pin group 213 of the COF chip in FIG. 6 is the same as that in FIG. 5 where the opened pin group 212 is located at two opposite sides of the second pin group 213.

It is indicated that, the gate driver IC chips GD1~GD3 in accordance with the second embodiment of the present invention can be COG chips or COF chips. A positional configuration of the opened pin group of each of the gate driver IC chips GD1~GD3 can be the same as that of the opened pin group 212 of each of the source driver IC chips SD1~SD8 in accordance with the second embodiment of the present invention.

In summary, in the above-mentioned embodiments of the present invention, the opened pin group which is formed at a side of one driver IC chip is located at at least one side of the second pin group, the excessive long transmission paths for signals in the prior art are removed off and thus the serious power drops can be relieved. Accordingly, the output of the driver IC chip can be effectively avoided to suffer from the dramatic influence of the serious power drops.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A display substrate of flat panel display, adapted to electrically couple with a plurality of cascade connected driver integrated circuit chips, wherein the cascade connected driver integrated circuit chips are electrically connected in series one after another, the display substrate of flat panel display comprising:

a display area having a plurality of display elements formed therein; and a plurality of fan-out wiring areas electrically coupled between the respective driver integrated circuit chips and the display area so as to transmit signal provided by the respective driver integrated circuit chips to the display area;

wherein at least one driver integrated circuit chip of the cascade connected driver integrated circuit chips each comprises a side and a plurality of output pins formed at the side, the output pins comprises a first pin group and a second pin group, the first pin group is electrically coupled to one of the fan-out wiring areas, and the second pin group is located at least one side of the first pin group and opened, wherein the second in group of only the tailmost driver integrated circuit chip is located at single side of the first pin group away from the other driver integrated circuit chip(s) and opened, and the tailmost driver integrated circuit chip is the last one of the cascade connected driver integrated circuit chips which a power signal supplied to the cascade connected driver integrated circuit chips arrives at.

2. The display substrate of flat panel display as claimed in claim 1, wherein the driver integrated circuit chips are source driver integrated circuit chips.

3. The display substrate of flat panel display as claimed in claim 1, wherein the driver integrated circuit chips are gate driver integrated circuit chips.

4. A display substrate of flat panel display, adapted to electrically couple with a plurality of cascade connected first-type driver integrated circuit chips and a plurality of cascade connected second-type driver integrated circuit chips, wherein the cascade connected first-type driver integrated circuit chips are electrically connected in series one after another, the cascade connected second-type driver integrated circuit chips are electrically connected in series one after another, the display substrate of flat panel display comprising:

a display area having a plurality of display elements formed therein;

a first fan-out wiring areas electrically coupled between the respective first-type driver integrated circuit chips and the display area so as to transmit first-type signals provided by the respective first-type driver integrated circuit chips to the display area, the first-type signals being for providing same functions applied to the display elements; and a second fan-out wiring areas electrically coupled between the respective second-type driver integrated circuit chips and the display area so as to transmit second-type signals provided by the respective second-type driver integrated circuit chips to the display area, the second-type signals being for providing same functions applied to the display elements;

wherein at least one first-type driver integrated circuit chip of the cascade connected first-type driver integrated circuit chips each comprises a side and a plurality of output pins formed at the side, the output pins comprise a first pin group and a second pin group, the first pin group is electrically coupled to one of the first fan-out wiring areas, and the second pin group is located at least one side of the first pin group and opened, wherein the second in group of only the tailmost first-type driver integrated circuit chip is located at single side of the first pin group away from the other first-type driver integrated circuit chip(s) and opened, and the tailmost first-type driver integrated circuit chip is the last one of the cascade connected first-type driver integrated circuit chips which a power signal supplied to the cascade connected first-type driver integrated circuit chips arrives at.

5. The display substrate of flat panel display as claimed in claim 4, wherein the first-type driver integrated circuit chips are source driver integrated circuit chips.

6. The display substrate of flat panel display as claimed in claim 4, wherein the first-type driver integrated circuit chips are gate driver integrated circuit chips.

7. A display having a display substrate adapted to electrically couple with a plurality of cascade connected driver integrated circuit chips, wherein the cascade connected driver integrated circuit chips are electrically connected in series one after another, the display substrate comprising:

a display area having a plurality of display elements formed therein; and a plurality of fan-out wiring areas electrically coupled between the respective driver integrated circuit chips and the display area so as to transmit signal provided by the respective driver integrated circuit chips to the display area;

wherein at least one driver integrated circuit chip of the cascade connected driver integrated circuit chips each comprises a side and a plurality of output pins formed at the side, the output pins comprises a first pin group and a second pin group, the first pin group is electrically coupled to one of the fan-out wiring areas, and the second pin group is located at least one side of the first pin group and opened, wherein the second pin group of only the tailmost driver integrated circuit chip is located at single side of the first pin group away from the other driver integrated circuit chip(s) and opened, and the tailmost driver integrated circuit chip is the last one of the cascade connected driver integrated circuit chips which a power signal supplied to the cascade connected driver integrated circuit chips arrives at.

8. The display as claimed in claim 7, wherein the driver integrated circuit chips are source driver integrated circuit chips.

9. The display as claimed in claim 7, wherein the driver integrated circuit chips are gate driver integrated circuit chips.

* * * * *